United States Patent [19]

Hero

[11] 3,953,093

[45] Apr. 27, 1976

[54] KITCHEN UNITS CONSISTING OF PREFABRICATED ELEMENTS

[75] Inventor: Franz Hero, Stafa, Switzerland

[73] Assignee: Team Form AG, Stafa, Switzerland

[22] Filed: Nov. 12, 1974

[21] Appl. No.: 523,177

[30] Foreign Application Priority Data

Nov. 12, 1973 Austria ..... 9488/73

[52] U.S. Cl. ..... 312/245; 5/9 R; 52/27; 312/351; 312/257 A

[51] Int. Cl.[2] ..... A47F 5/08

[58] Field of Search ..... 312/245, 351, 27; 52/122, 126, 480; 5/9

[56] References Cited

UNITED STATES PATENTS

| | | | |
|---|---|---|---|
| 2,965,428 | 12/1960 | Jacobs et al. | 312/245 |
| 3,025,122 | 3/1962 | Millman | 312/245 |
| 3,324,614 | 6/1967 | Loewenau | 52/126 |
| 3,362,768 | 1/1968 | Fink et al. | 312/245 |
| 3,645,054 | 2/1972 | Olvera | 52/126 |

*Primary Examiner*—Casmir A. Nunberg
*Attorney, Agent, or Firm*—Sughrue, Rothwell, Mion, Zinn and Macpeak

[57] ABSTRACT

A kitchen cabinet, stove, sink, etc. installation including floor units 11 mounted on horizontal floor rails 1, 1*a*, overhead cabinets 13 mounted on horizontal wall rails 3, and full length cabinets mounted on both a floor rail and a wall rail. The installation provides for dead space A behind the cabinets for piping, electrical wiring, etc. Removable splash boards 15 are installed between the floor units and the overhead cabinets, with the latter being held out from the wall by spacers 5.

7 Claims, 14 Drawing Figures

13
16
9
9a
13a
14
15

31
19
1
2
A
H 31
13
16
15
9
11
1
2
1a
A
5
H

KITCHEN UNITS CONSISTING OF PREFABRICATED ELEMENTS

BACKGROUND OF THE INVENTION

1. Field of the Invention

The present invention relates to kitchen units made up of prefabricated elements consisting of elements resting on the floor such as the stove, under-counter cabinets, etc., of elements secured to a wall such as wall cabinets and the like and possibly of elements which both rest on the floor and are secured to a wall such as tall cabinets, etc.

2. Description of the Prior Art

When installing kitchen units consisting of prefabricated elements it was hitherto customary to proceed as follows: individual combinable elements were mounted adjacent to each other and above one another. Wall cabinets were screwed to the wall using individual mountings. Work surfaces were fitted, mounted and sealed along the wall with covering strips. The wall surface between lower and upper cabinets was generally panelled.

This method has various disadvantages. Firstly, the work surfaces had to be fitted at the actual installation site. The individual elements could not be preselected very accurately. Complicated fitting pieces were required between the cabinets and the walls. The work surface had to be of a very simple construction to enable the units to be adjusted in the above-described manner at the installation site with the available tools.

SUMMARY OF THE INVENTION

The object of the present invention is to obviate these disadvantages and to improve the preplanning and manufacture of kitchen units so that installation is rendered simpler and more rapid.

According to the invention this problem is solved in that the elements which only rest on the floor are mounted on a horizontal, perfectly true supporting bar with a parallel profile bar in such a way that their rear side is spaced a specific distance from the wall and in that the elements which are secured to the wall are suspended the same distance from the wall on a bar which is anchored to the wall and which is spaced at a specific distance from the supporting bar and in that any elements which both rest on the floor and are secured to the wall are both secured to the base frame and suspended on the bar.

The following technical advantages are obtained by means of this arrangement: When the kitchen units are being installed, the supporting bar is secured to the floor at a specific distance from the wall and levelled. A parallel profile bar may also be provided. The suspension bar is then secured to the wall at a specific distance from the upper surface of the supporting bar. This can be effected with brace elements so that each assembler is able to accurately align the supporting bar and suspension bar with respect to each other. The supporting bar and the suspension bar form the assembly base for all the elements to be installed. These can now be mounted with practically no adjustment. The dimensions of the elements to be installed are obviously planned according to an accurate scale in a manner known per se, and the securing elements provided thereon are designed to fit the corresponding elements on the supporting bar and suspension bar.

The advantage of installing the elements at a distance from the wall is that connections for hot and cold water, drainage, electrical current, telephone, etc. do not have to be disposed where structural provision has been made for the same. The necessary connection lines can be located arbitrarily in the space behind the rear wall of the elements being installed.

According to another feature of the invention, in the case of elements such as stoves, under-counter cabinets, etc. which have a work surface on their upper side and above which an element secured to the suspension bar, for example, a wall cabinet, is located, a removable rear wall is provided between the rear side of the work surface and the element suspended on the suspension bar. This rear wall is designed to receive sockets, clocks, timers, etc. and attachments for charts, shelves, etc.

Other objects, features and advantages of the present invention will be made apparent from the following detailed description of a preferred embodiment thereof which is provided in reference to the accompanying drawings.

DESCRIPTION OF THE PREFERRED EMBODIMENT

Figure 2:
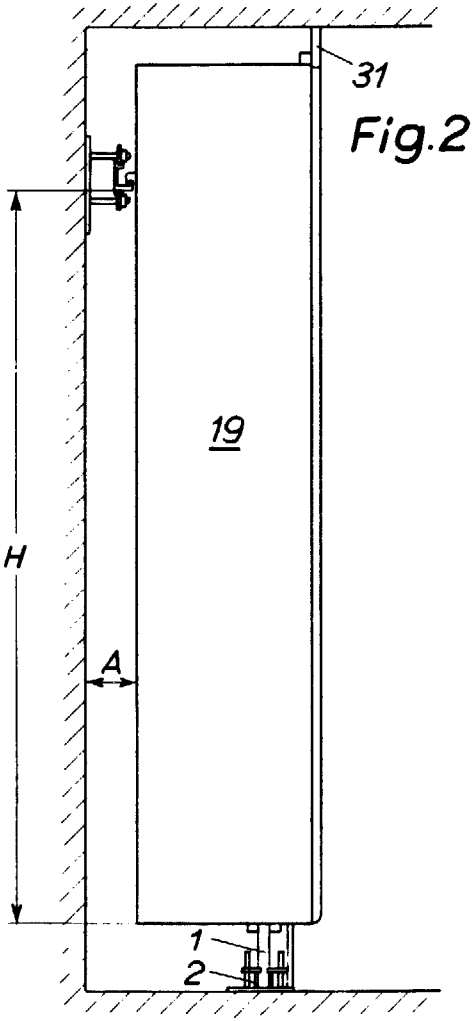
FIG. 2 shows a side view of the unit shown in FIG. 1 but with a tall cabinet.
Figure 1:
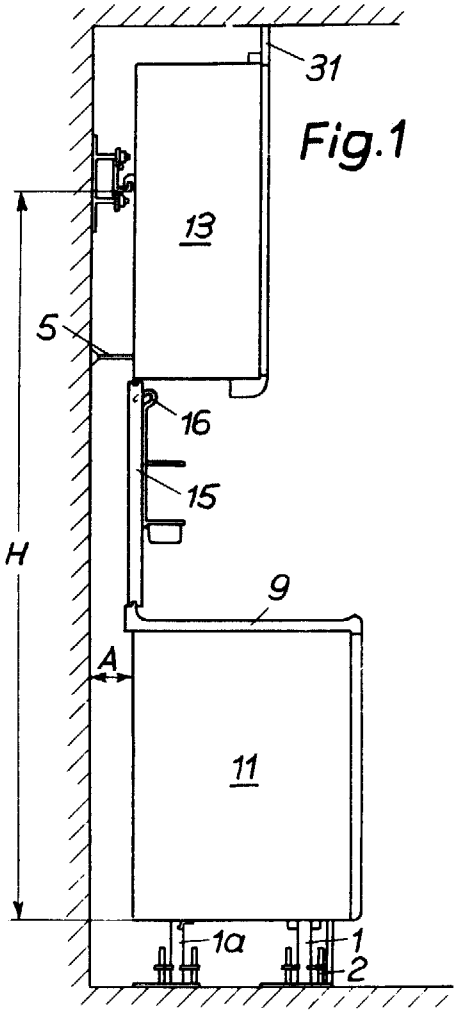
FIG. 1 shows a diagrammatic side view of a kitchen unit assembled according to the invention comprising an under-counter cabinet and a wall cabinet.
Figure 4:
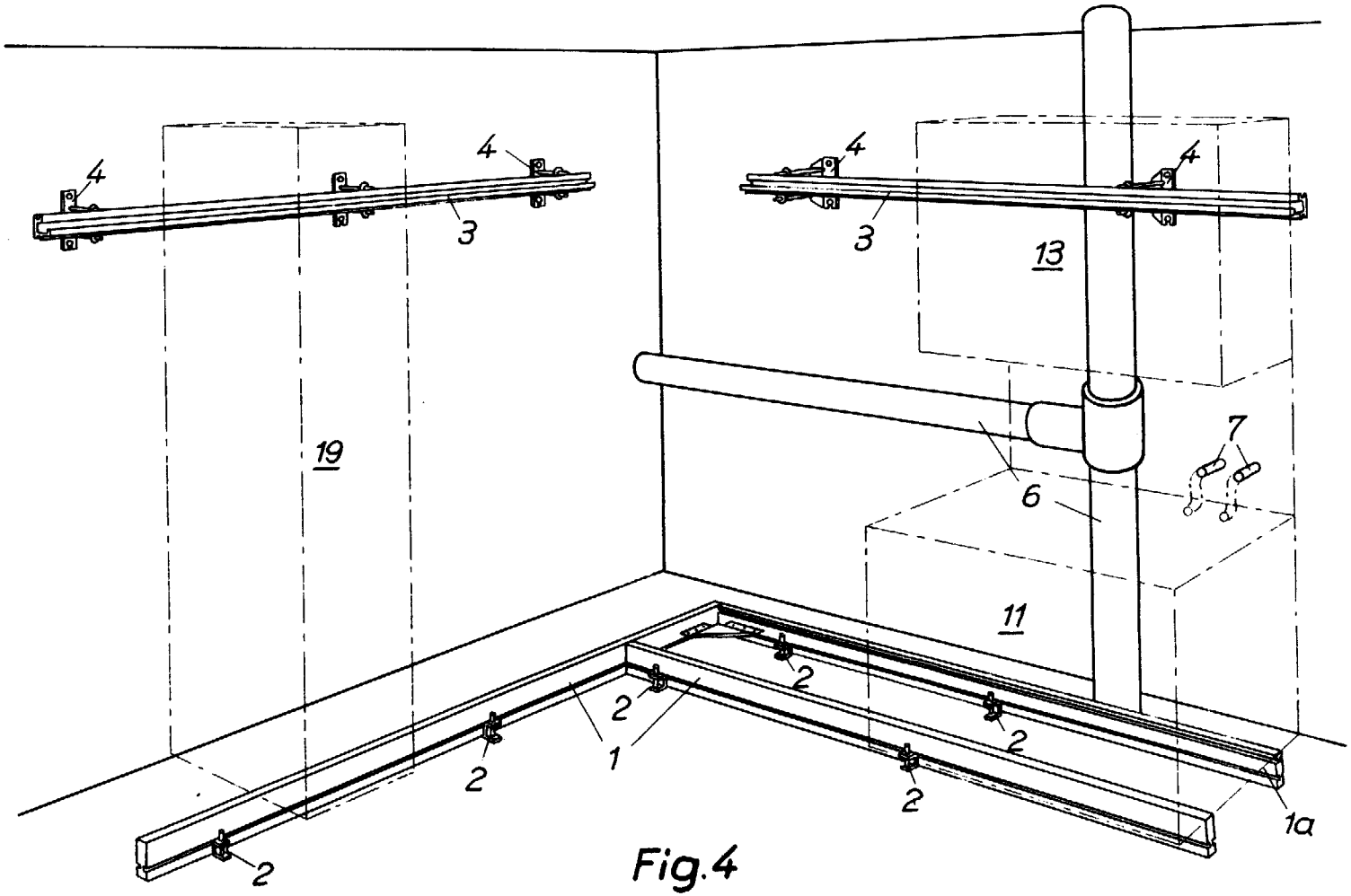
FIG. 4 is a perspective view of an installed supporting bar and suspension bars.

FIGS. 1, 2 and 4 show the assembly principle for the individual elements 11, 13, 19. Supporting bars 1 or 1*a* are secured to the kitchen floor at a distance from the walls. These supporting bars are disposed in vertically adjustable holders 2. Suspension bars 3 are secured to the walls in holders 4. The bars 3 disposed at an accurately determined distance H above the upper edge of the supporting bar 1 (see FIGS. 1 and 2). The structure of the supporting bar 1 or 1*a* and the suspension bar 3 will be described in further detail hereinafter.

Two parallel profile bars 1 and 1*a* are disposed along the walls on which only elements resting on the ground, for example, under-counter cabinets 11, stoves, etc., are to be arranged (FIG. 1). If only tall cabinets 19 are to be installed along a wall, it is only necessary to provide a single supporting bar 1. The tall cabinet 19 is then secured to this supporting bar and to the suspension bar 3 (FIG. 2). Wall cabinets 13 are only suspended on the suspension bars 3. On the underside of their rear wall the wall cabinets are provided with adjustable, horizontal spacing elements 5 for example, adjusting screws, which facilitates accurate vertical adjustment of the cabinets.

All the elements to be installed are mounted at a distance A from the wall (FIGS. 1 and 2). In this way it is possible to set up the kitchen units without regard to the existing drainage lines 6 or to the position of water main connections 7, current connections, telephone connections, ventilation lines, etc. Corresponding connection lines can be installed in the space A. The breadth of this space can be designed to suit the particular requirements.

Figure 10B:
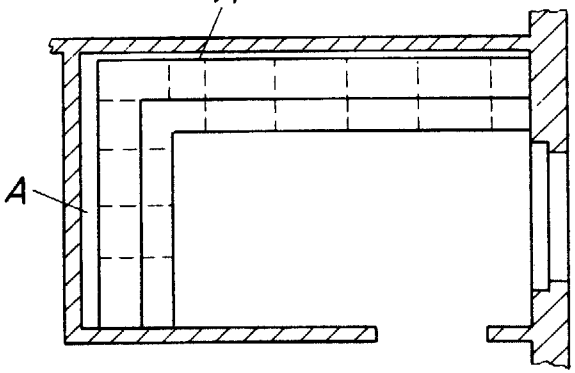
FIGS. 10*a* – 10*b* show floor plans of various kitchen units.
Figure 10D:
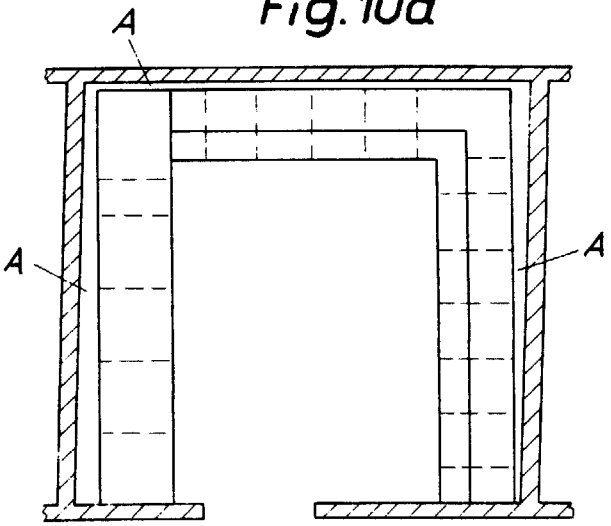
Figure 10A:
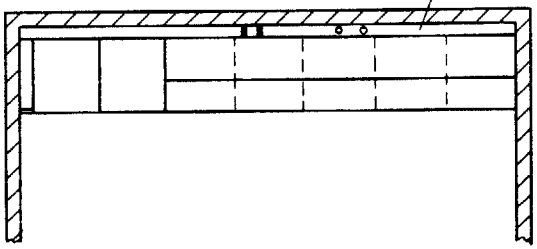
Figure 10C:
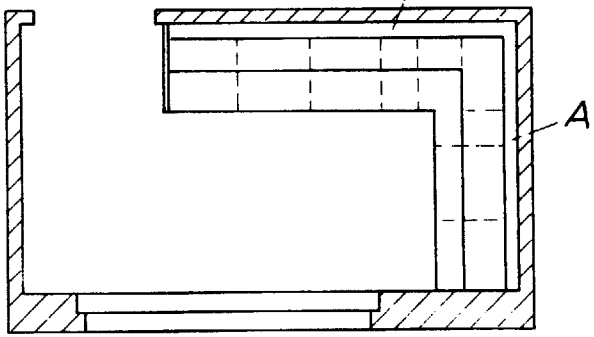

However, the intermediate space A also meets another requirement. As the individual elements to be incorporated have been manufactured according to a precise scale, in the assembled state, their total length and width will always correspond to a complete multiple of the scale division. The kitchen units can now be combined as desired as represented in the floor plans shown in FIGS. 10*a* – 10*d*. As the spacing of the kitchen walls seldom corresponds exactly to the dimensions of the installed elements, the intermediate spaces A also compensate for any variations in length and breadth and for any possible variations from the specified masonry measurements. In most cases, the kitchen units can be installed without using any adjustment pieces, thus saving considerable work. Only with the layout shown in FIG. 10*a* is it generally necessary to secure a simple covering screen on one side.

Figure 3:
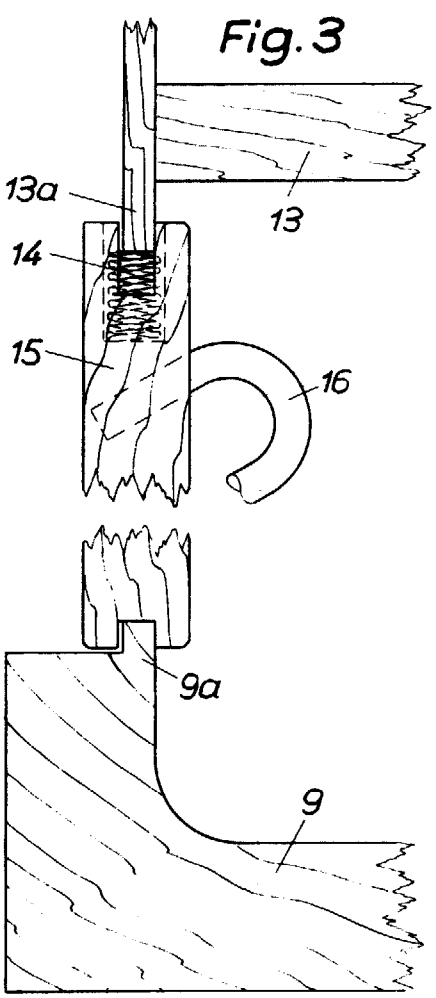
FIG. 3 shows a vertical section through a suspended rear wall on an enlarged scale.
Figure 6:
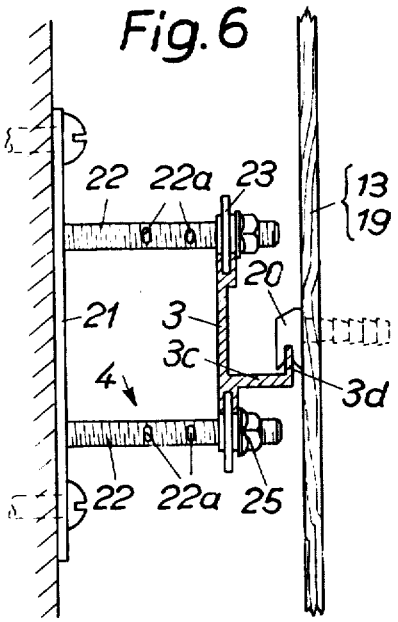
FIG. 6 shows a vertical section through a suspension bar with its securing screws.
Figure 7:
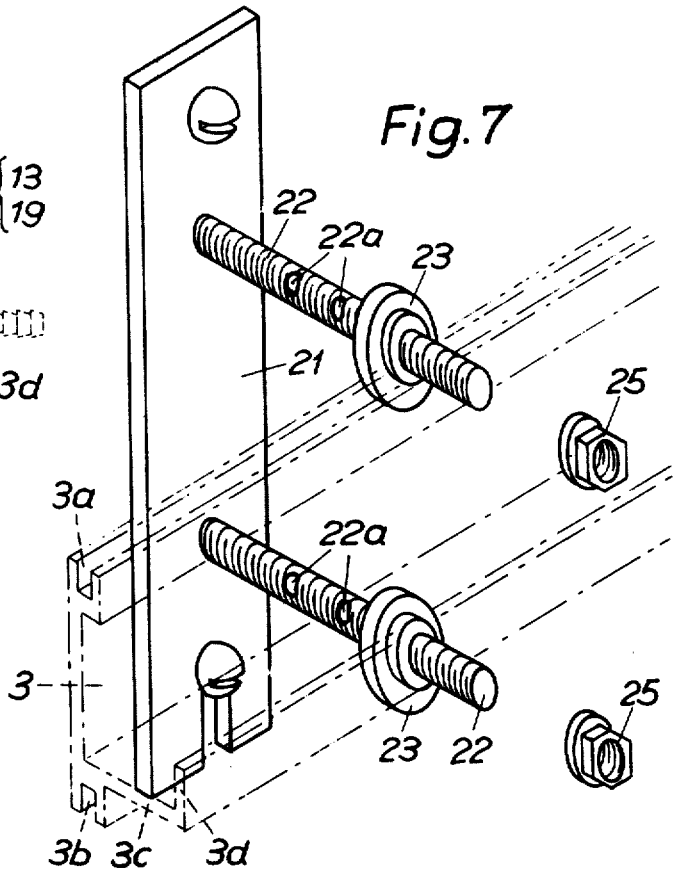
FIG. 7 is a perspective view of the securing screws.
Figure 6A:
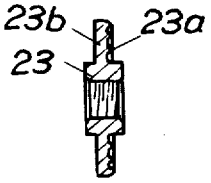
FIG. 6*a* is an axial section through a retaining nut.

As is apparent from FIGS. 1 and 3, the work surfaces 9 of the under-counter cabinets 11 are provided with an upwardly projecting flange 9*a* (see FIG. 3). The rear wall of the wall cabinets 13 is provided with a downwardly projecting extension flange 13*a*. A rear wall 15 which is provided with grooves corresponding to the flanges is suspended in the flanges 13*a* and 15*a*. This is pressed downwards by a number of springs 14 let into the upper groove. To remove the rear wall 15, it is merely necessary to raise the same against the pressure of the springs 14 and then draw it forwards and downwards. Electrical devices such as connection plugs, clocks, timers for the stove, etc. and holders 16 for small shelves and the like can be mounted on this rear wall. The structure of the supporting bar and the suspension bars 3 and their securing elements will now be described in further detail. The suspension bar 3 has a generally L-shaped cross-section (FIGS. 6, 7). At its upper and lower parts it is provided with flanges having a U-shaped cross-section which each define a longitudinal groove 3*a*, 3*b*. On its horizontal arm 3*c*, the suspension bar 3 is also provided with a vertical, upwardly directed flange 3*d* in which the holders 20 secured to the rear walls of the wall cabinets 13 or tall cabinets 19 are adapted to engage. The bar 3 is supported by two or more holders 4. Each holder 4 comprises a rear plate 21 which is screwed to the wall. It bears two plug bolts 22, on each of which is disposed a disc-shaped retaining nut 23 (see also FIG. 6*a*). The disc-shaped part 23*a* which is provided with a groove 23*b* on its front side engages in the grooves 3*a* or 3*b* of the bar 3. By turning the retaining nuts 23, the desired spacing from the wall can be obtained. The bar 3 is then secured by means of the retaining nuts 25. The bolts 22 are provided with notches 22*a* which represent breaking points. After the suspension bars 3 have been adjusted and secured in place, the projecting parts of the bolts 22 can thus be broken off at these breaking points.

Figure 5:
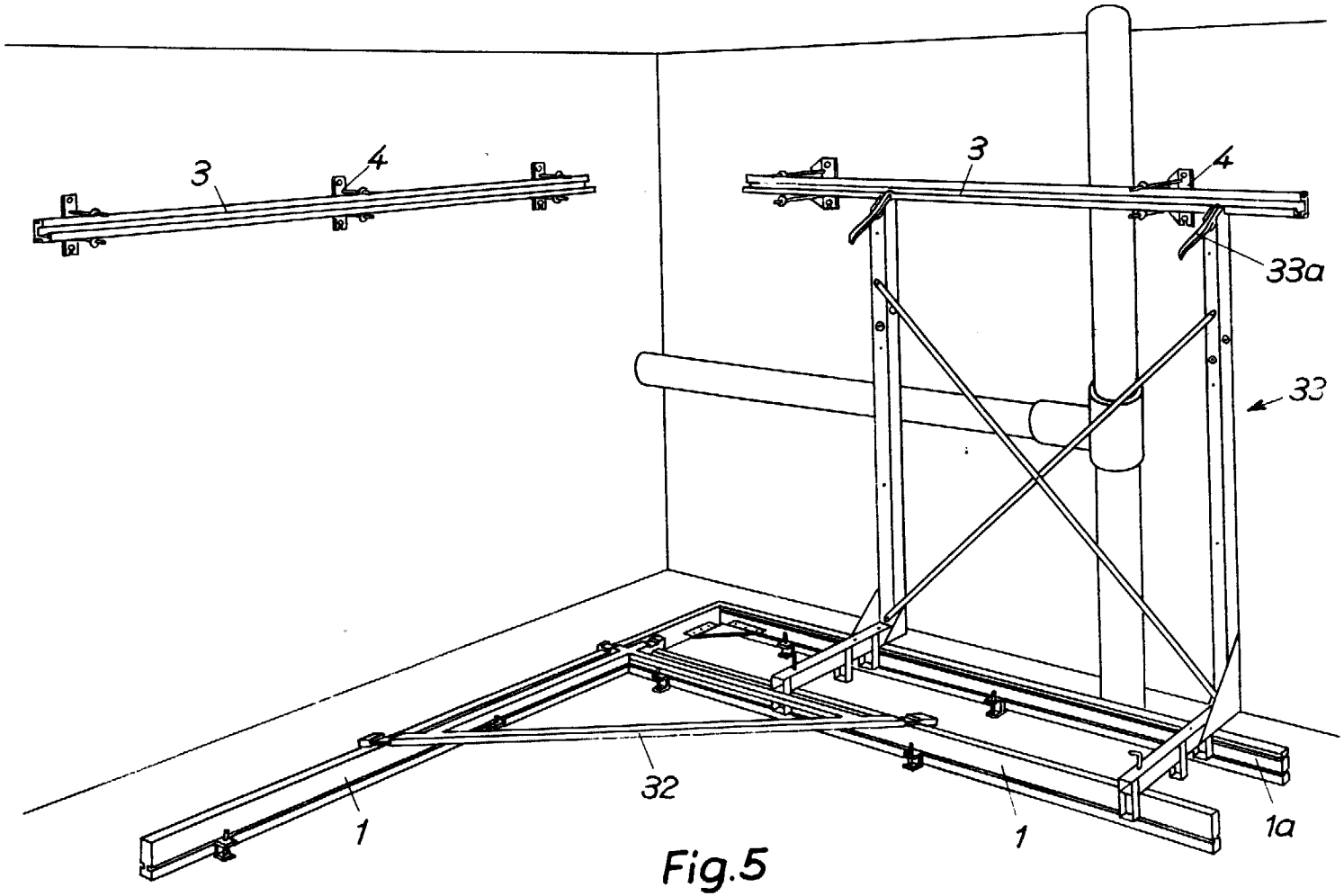
FIG. 5 is a view according to FIG. 4, with braces used to mount the supporting bar.
Figure 8:
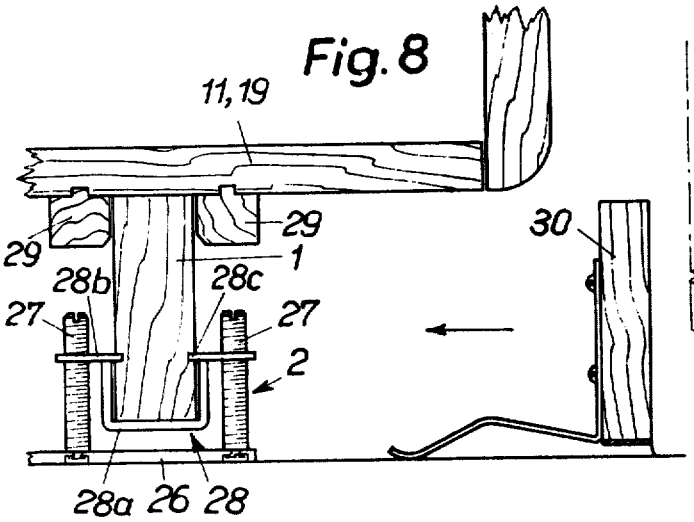
FIG. 8 shows a vertical section through a supporting bar.
Figure 9:
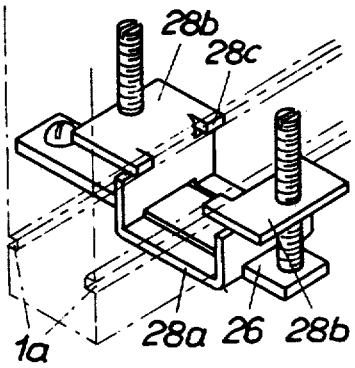
FIG. 9 is a perspective view of the holder of a supporting bar.

The supporting bars represented in FIGS. 8 and 9 consist of wooden strips 1 which are secured in holders 2. The holders 2 comprise a base plate 26 which is screwed to the floor. Two plug bolts 27 are rotatably mounted in the base plate 26. These bear a holder 28 which comprises a U-shaped part 28*a* and two horizontal arms 28*b*. Projections 28*c* on the arms 28*b* project into longitudinal grooves 1*a* of the strip 1. By rotating the plug bolt 27, the holder 28 can be vertically adjusted. Pairs of guide strips 29 are attached to the underside of the under-counter and tall cabinets 11 and 19. The strip 1 engages between these guide strips 29. After the support bars and their holders have been mounted, they are covered with screens 30. Screens 31 can also be attached to the upper side of the wall cabinets 13 and to the tall cabinets 19. As already stated, the support bars 1 and 1*a* and the suspension bars 3 are assembled by means of braces. These are represented in FIG. 5. The rightangled position of the support bar 1 is accurately engaged by the angle brace 32. If the support bars 1 are perfectly aligned horizontally, for example, by means of a water level, a brace 33 is mounted which supports the suspension bar 3 in holders 33*a* so that this bar can be secured to the wall by means of the holder 4 at the exact distance H from the supporting bar 1. The individual parts of the brace may be collapsible thus facilitating transportation of the same.

What is claimed is:

1. Kitchen units including prefabricated elements resting only on the floor, such as stoves, floor cabinets, etc., elements (13) secured to a wall, such as overhead cabinets, and elements (19) resting on the floor and secured to a wall, such as tall cabinets, characterized in that the elements (11) are installed on a horizontally aligned supporting bar (1) and a profile bar (1a) in such a way that their rear side is disposed at a distance (A) from the wall, in that the elements (13) which are secured to the wall are suspended at the same distance (A) from the wall on a profile bar (3) which is anchored on the wall and arranged at a predetermined distance (H) from the supporting bar (1), and the elements (19) which both rest on the floor and are secured to the wall are secured to the supporting bar (1) and suspended on the bar (3), the profile bar (3) having a generally L-shaped cross-section, two oppositely directed grooves (3a, 3b) and a vertical flange (3d) on a horizontal arm (3c), a holder (20) which is connected to the elements (13, 19) engaging in said vertical flange.

2. Kitchen units as claimed in claim 1, wherein only the elements installed on the supporting bar (1) and the profile bar (1*a*) have a work surface on their upper side, characterized in that between the rear side of the work surface (9) and the rear side of the elements (13) which are only suspended on the bar (3), there is a removable rear wall (15).

3. Kitchen units as claimed in claim 1, wherein only the elements (13) suspended on the bar (3) are provided on the underside of their rear wall with horizontal, adjustable spacer elements (5) known per se, for example, adjusting screws.

4. Kitchen units as claimed in claim 1, wherein the supporting bars (1) and the profile bars (1*a*) are secured in a U-shaped part (28*a*) of a holder (28) which comprises horizontal arms (28*b*) provided with tap holes for receiving plug bolts (27) which are rotatably supported in a base plate (27).

5. Kitchen units as claimed in claim 4, wherein the supporting bars (1) engage between guide strips (29) on the base of the under-counter cabinets (11) and of the tall cabinets (19).

6. Kitchen units as claimed in claim 1, wherein a holder (4) is provided with a rear plate (21) in which are secured two plug bolts (22) on which are disposed two disc-shaped retaining nuts (23) which engage in the grooves (3*a*, 3*b*) of the bar (3).

7. Kitchen units as claimed in claim 6, wherein the plug bolts (22) are provided with breaking points in the form of notches (22*a*).

* * * * *